US012225986B2

(12) United States Patent
Payne

(10) Patent No.: US 12,225,986 B2
(45) Date of Patent: Feb. 18, 2025

(54) ZIPPER PULLER

(71) Applicant: Travelpro Products, Inc., Boca Raton, FL (US)

(72) Inventor: Jonathan Payne, Lake Worth, FL (US)

(73) Assignee: Travelpro Products, Inc., Boca Raton, FL (US)

( * ) Notice: Subject to any disclaimer, the term of this patent is extended or adjusted under 35 U.S.C. 154(b) by 0 days.

(21) Appl. No.: 18/242,256

(22) Filed: Sep. 5, 2023

(65) Prior Publication Data

US 2024/0074545 A1 Mar. 7, 2024

Related U.S. Application Data

(60) Provisional application No. 63/403,549, filed on Sep. 2, 2022.

(51) Int. Cl.
*A44B 19/26* (2006.01)

(52) U.S. Cl.
CPC ..... *A44B 19/262* (2013.01)

(58) Field of Classification Search
CPC ..... A44B 19/262
See application file for complete search history.

(56) References Cited

U.S. PATENT DOCUMENTS 5,187,842 A * 2/1993 Akashi ..... A44B 19/262 24/429
5,878,467 A * 3/1999 Yokota ..... A44B 19/262 24/429
6,035,497 A 3/2000 Jackson
D745,433 S 12/2015 Dieter
(Continued)

FOREIGN PATENT DOCUMENTS

CA 1678585 9/2016
CN 2516001 10/2002
(Continued)

OTHER PUBLICATIONS

Detachable zip puller, https://www.aliexpress.com/2255800779331399.html?gatewayAdapt=4itemAdapt; printed Aug. 23, 2023.
(Continued)

*Primary Examiner* — David M Upchurch
(74) *Attorney, Agent, or Firm* — Akerman LLP; Ryan Harding

(57) ABSTRACT

A zipper puller configured to connect to a zipper slider includes a puller portion and a loop portion. The puller portion may include arm channels, an extension slot located along each arm channel, and a tab slot located within each extension slot. The loop portion may include a loop to loop through a zipper slider connector, arms extending from the loop, and an extension extending from each arm, where each extension includes a tab. The puller portion and the loop portion are configured to couple to connect the zipper puller to a zipper slider. The arms may be configured to flex outwardly to position tabs within arm channels such that the arms may translate along the arm channels toward the extension slots. The arms may be resilient when flexed to urge the extensions into the extension slots along the arm channels to position the tabs within the tab slots, thereby coupling the puller portion and loop portion.

20 Claims, 4 Drawing Sheets

(56) References Cited

U.S. PATENT DOCUMENTS

| | | | | |
|---|---|---|---|---|
| 11,185,134 | B2 * | 11/2021 | Cowdery | A44B 19/30 |
| 2004/0148745 | A1 | 8/2004 | Moeller et al. | |
| 2013/0212841 | A1 | 8/2013 | Castaline et al. | |
| 2017/0156453 | A1 * | 6/2017 | Burke | A44B 19/262 |
| 2020/0229551 | A1 * | 7/2020 | Detry | A45C 13/103 |

FOREIGN PATENT DOCUMENTS

| | | |
|---|---|---|
| CN | 201585508 | 9/2010 |
| CN | 105982396 | 10/2016 |
| CN | 210407326 | 4/2020 |
| CN | 210492907 | 5/2020 |
| CN | 210642820 | 6/2020 |
| CN | 211065273 | 7/2020 |
| CN | 217337623 | 9/2022 |
| CN | 217487828 | 9/2022 |
| CN | 217695459 | 11/2022 |
| CN | 217851650 | 11/2022 |
| EP | 0821892 | 6/2003 |
| KR | 20160004018 | 11/2016 |

OTHER PUBLICATIONS

Denim Accessories Zipper Puller Design, https://www.pinterest.com/pin/376472850075236088/, printed Aug. 23, 2023.

* cited by examiner

ZIPPER PULLER

CROSS REFERENCE TO RELATED APPLICATIONS

This application claims the priority benefit of U.S. Provisional Application No. 63/403,549, filed Sep. 2, 2023, the entirety of which is incorporated herein by reference.

FIELD OF TECHNOLOGY

The present application is directed to zipper pullers for attachment to a puller connection of a zipper slider.

BACKGROUND

Zippers are ubiquitous fastening systems that typically include two complementary strips of metal or plastic teeth that may be meshed together to couple separate sides or articles. A zipper slider connects to the complementary strips of teeth whereby translation of the slider interlocks or separates the strips depending on the direction the slider is translated. Pullers typically have a zipper puller connection for connecting a zipper puller. The puller allows a user to more easily grip and translate the slider in the desired direction. Pullers often break, falloff, or otherwise become unusable or undesirable. What is need are improved zipper pullers that may be easily and conveniently attached to new or existing sliders.

SUMMARY

In one aspect, a zipper puller configured to connect to a zipper slider includes a puller portion and a loop portion. The puller portion includes a first arm channel that extends along a first lateral side and a second arm channel that extends along a second lateral side. A first extension slot is located along the first arm channel and a second extension slot located along the second arm channel. A first tab slot is located within the first extension slot and is defined through a surface of the puller portion and a second tab slot is located within the second extension slot and is defined through the surface of the puller portion. The loop portion includes a loop to pass through a zipper slider connector and a first arm and a second arm, each arm extending approximately parallel from the loop. A first extension including a first tab extends toward the second arm and a second extension including a second tab extends toward the first arm. The puller portion and the loop portion are configured to couple to connect the zipper puller to a zipper slider. The first and second arms may be configured to flex away from each other to position the first and second tabs within corresponding first and second arm channels such that the respective arms may translate along the respective arm channels toward the respective extension slots. The first and second arms may be resilient when flexed to urge the first and second extensions into the respective extension slots along the arm channels to position the first and second tabs within the first and second tab slots and therein provide an interference fit thereby coupling the puller portion and loop portion.

In one example, the first and second tab slots have a trapezoidal shape.

In the above or another example, the first and second tabs have a trapezoidal shape with a leading acute interior angle.

In any of the above or another example, the first and second arm channels are open along the lateral side of the puller portion.

In any of the above or another example, the zipper puller extends along a longitudinal axis, and the first and second tab slot longitudinally overlap relative to the longitudinal axis. The first and second tab slots may extend across a longitudinal centerline of the zipper puller.

In any of the above or another example, the first and second tabs include an upper surface, and the upper surface positions above the respective arm from which the tab extends.

In another aspect, a zipper puller configured to connect to a zipper slider includes a puller portion and a loop portion. The puller portion may include arm channels, an extension slot located along each arm channel, and a tab slot located within each extension slot. The loop portion may include a loop to loop through a zipper slider connector, arms extending from the loop, and an extension extending from each arm, where each extension includes a tab. The puller portion and the loop portion are configured to couple to connect the zipper puller to a zipper slider. The arms may be configured to flex outwardly to position tabs within arm channels such that the arms may translate along the arm channels toward the extension slots. The arms may be resilient when flexed to urge the extensions into the extension slots along the arm channels to position the tabs within the tab slots, thereby coupling the puller portion and loop portion.

In one example, at least one tab slot is defined in an upper surface of the puller portion.

In the above or another example, at least one tab slot has a trapezoidal shape.

In any of the above or another example, at least one tab has a leading distal edge that tapers toward the loop.

In any of the above or another example, at least one arm channel extends along a lateral side of the puller portion and the lateral side is open.

In any of the above or another example, the arm channels comprise a first arm channel that extends along a first lateral side of the puller portion and a second arm channel that extends along a second lateral side of the puller portion that is different from the first lateral side.

In any of the above or another example, the arms extend from the loop approximately parallel to each other.

In any of the above or another example, a first extension along a first arm extends from the first arm toward a second arm, and a second extension along the second arm extends from the second arm toward the first arm.

In any of the above or another example, the zipper puller extends along a longitudinal axis and a first and a second tab slot longitudinally overlap relative to the longitudinal axis. In a further example, the first and second tab slots extend across a longitudinal centerline of the zipper puller.

In any of the above or another example, the tabs include an upper surface that positions above the arm from which the tab extends.

DRAWINGS

The novel features of the described embodiments are set forth with particularity in the appended claims. The described embodiments, however, both as to organization and manner of operation, may be best understood by reference to the following description, taken in conjunction with the accompanying drawings in which:

FIGS. 1A-1C illustrate a zipper puller according to various embodiments described herein, wherein FIG. 1A shows a loop portion lined up with a puller portion, FIG. 1B shows a lower side view of the loop portion connected to the puller portion and FIG. 1C shows an upper side view;

FIGS. 2A-2C illustrate a zipper puller according to various embodiments described herein, wherein FIG. 2A shows a loop portion lined up with a puller portion, FIG. 2B shows an upper side view of the loop portion connected to the puller portion, and FIG. 2C depicts assembly of the zipper puller, indicating where the extension including a tab slots into an extension slot;

DESCRIPTION

Figure 1A:
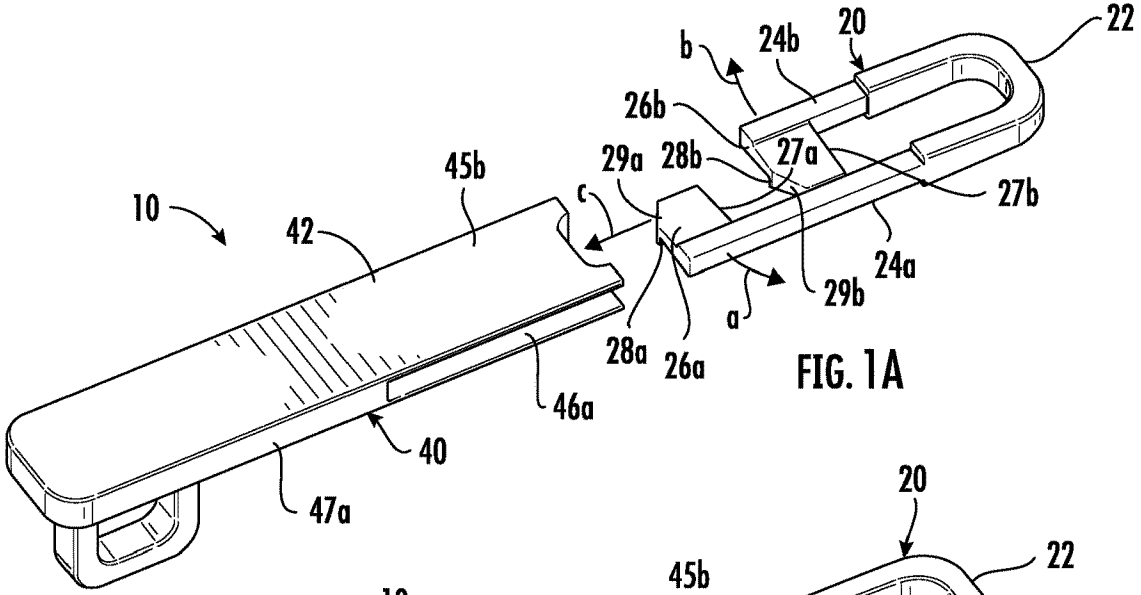
Figure 1B:
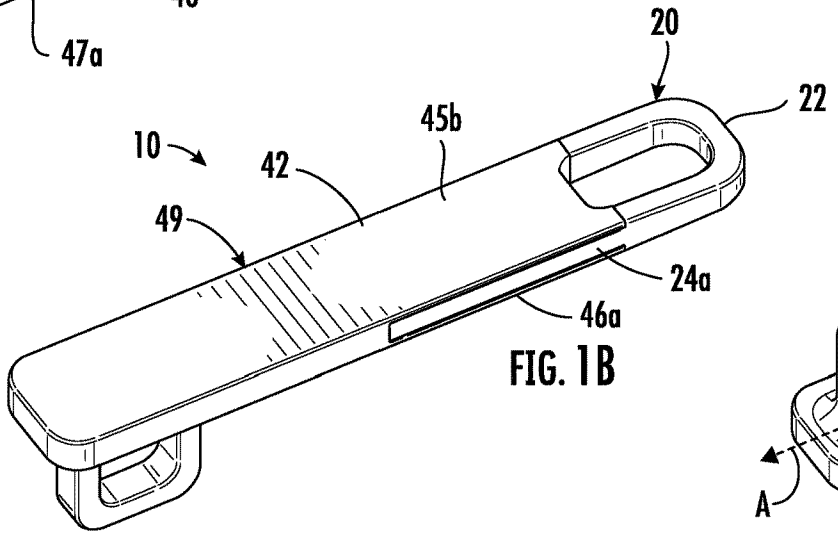
Figure 1C:
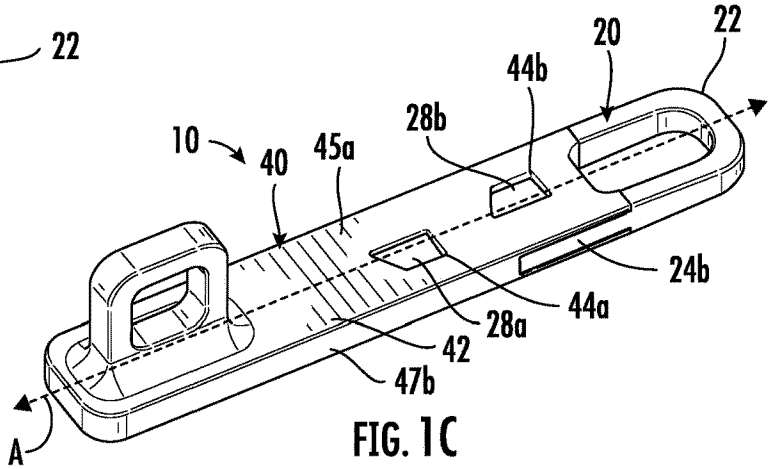
Figure 2B:
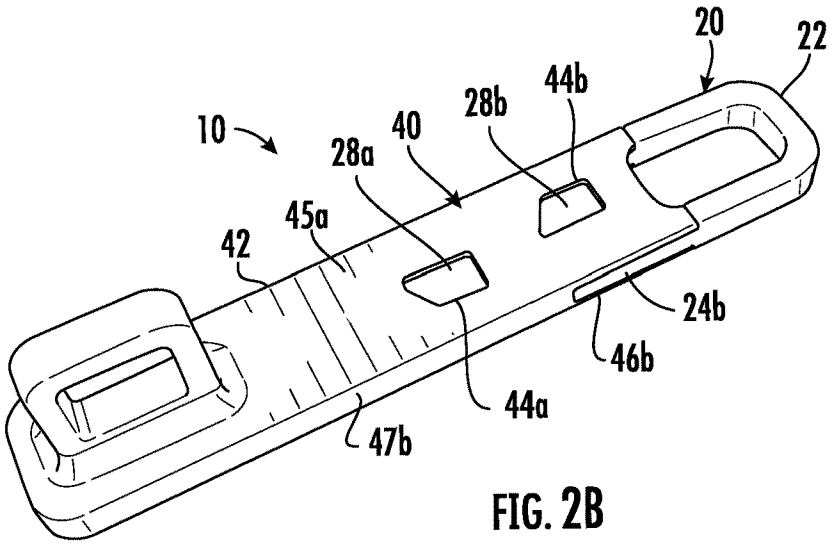
Figure 2A:
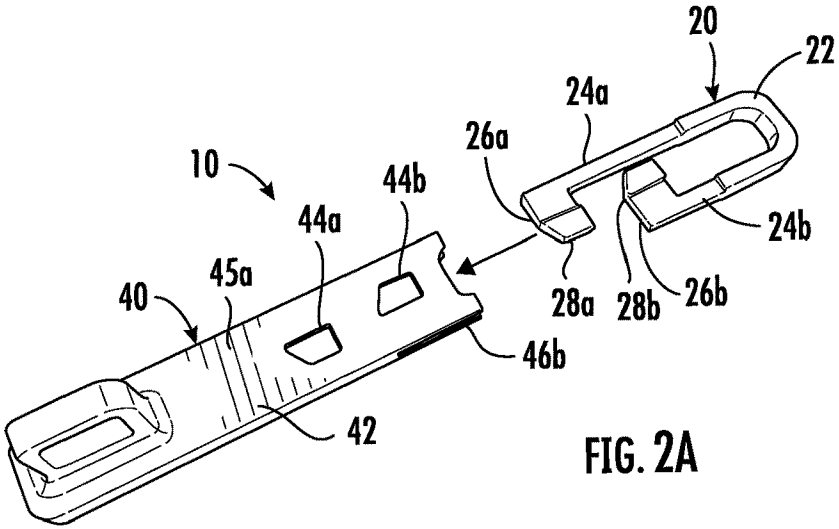
Figure 2C:
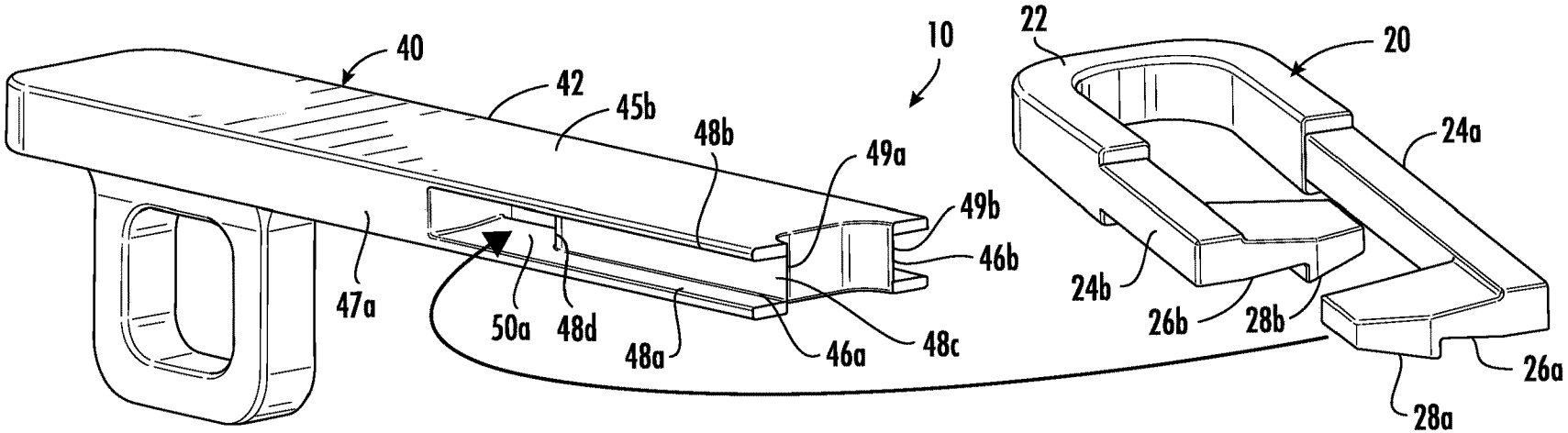
Figure 3A:
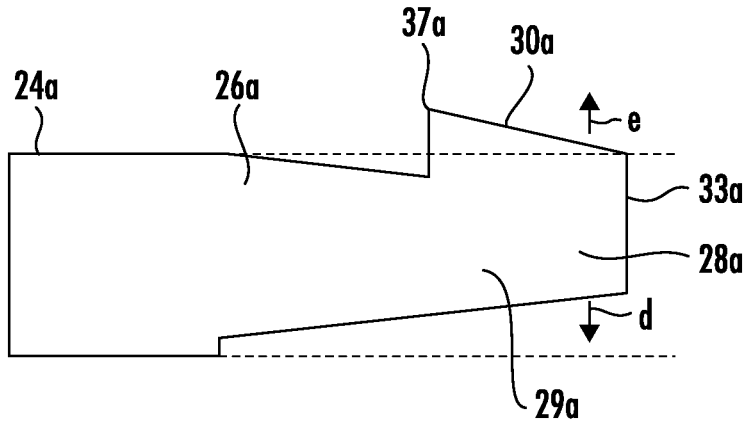
FIG. 3A illustrates and end view of an arm and extension including a tab of a loop portion according to various embodiments described herein.
Figure 3B:
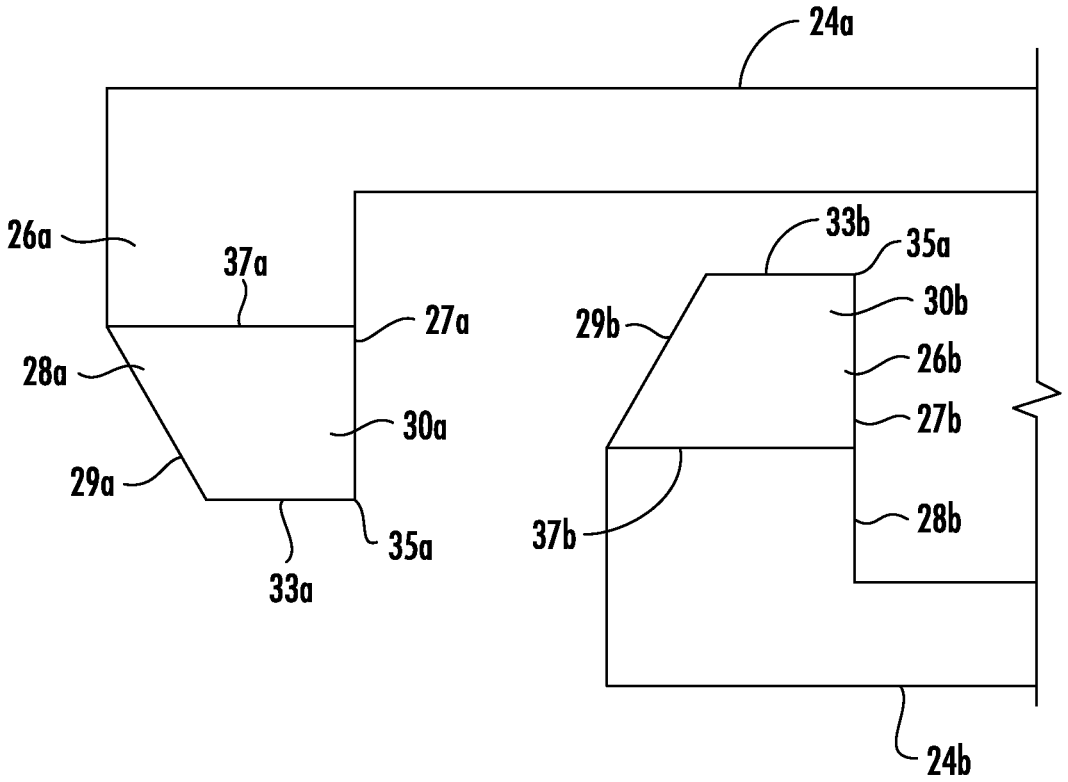
FIG. 3B illustrates an overhead view of arms and extensions including tabs of a loop portion according to various embodiments described herein.
Figure 4:
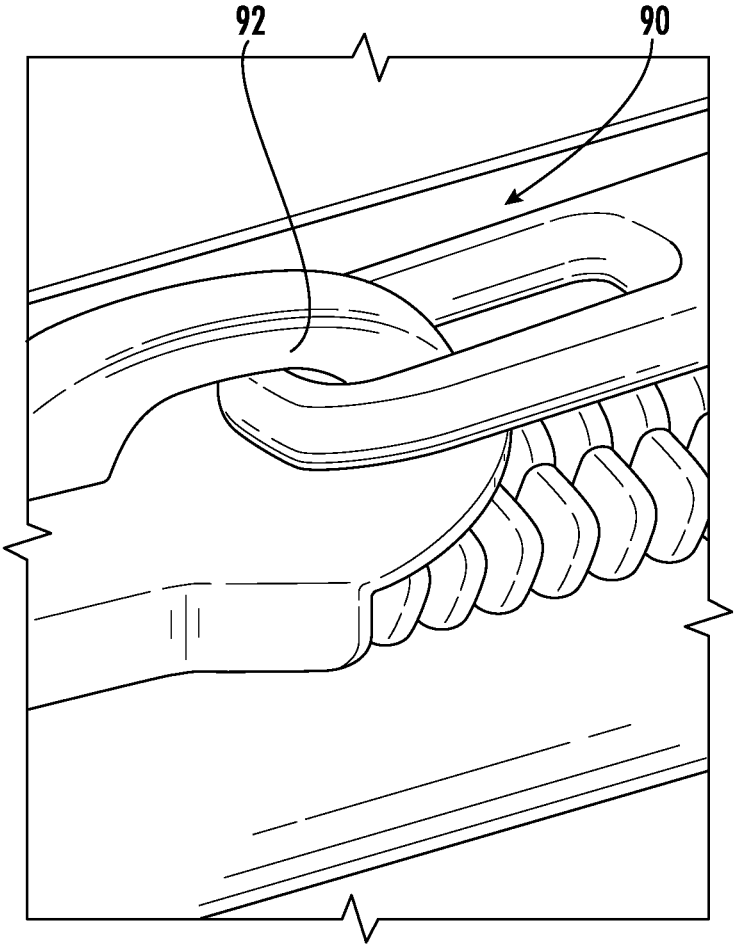
FIG. 4 PRIOR ART
FIG. 4 illustrates a prior art zipper slider suitable for connection with various embodiments of the zipper puller described herein.

In various embodiments, a zipper puller described herein is configured to connect to a zipper slider. The zipper puller may be configured to provide a convenient replacement to broken or lost zipper pullers. The zipper puller may be provided with new zipper sliders. The zipper puller may comprise a connector configured to connect to the slider. The zipper puller may include a puller portion configured to connect to a connector portion. The connection may lock the puller and connector portions together. To connect the zipper puller to a zipper slider, the connector portion may be extended through a connector, such as a hook or loop, provided on the zipper slider. The connector portion may then be connected to the puller portion to prevent the connector portion from being removed from the connector of the zipper slider. The puller connector may include one or more extensions or arms configured to slot into one or more channels defined in the puller portion. The channel may include one or more slots to receive one or more tabs disposed on the one or more arms. The slots may be dimensioned to receive the one or more tabs. Tabs or arms may be shaped and/or biased such that when tabs slot into slots, removal of the tabs from the slots, channels, or both requires applying a force to cause flexure in the puller connector. In some embodiments, the puller connector and puller portion are configured to be selectively connected and disconnected.

With reference to FIGS. 1A-4, a zipper puller 10 may include a loop portion 20 comprising a loop 22 configured to connect to a puller connector 90 of a zipper slider 92. Puller connectors 90 typically include a loop or hook to which the loop 22 of the loop portion 20 extends through or around. The loop portion 20 may be configured to engage and lock with a puller portion 40. The puller portion 40 includes a puller body 42 to which the loop portion 20 engages to connect to the puller portion 40. The puller body 42 may include channels, slots, or both through which the loop portion 20 connects thereto. In use, connecting with the puller portion 40 may close the loop 22 of the loop portion 20, thereby securing the loop portion 20 and puller portion 40 to the slider 92 when the loop 22 extends through the puller connector 90.

The loop portion 20 may include spaced apart arms 24*a*, 24*b* that extend from the loop 22. The loop 22 of the loop portion 20 will typically comprise a rigid structure sufficient to provide the spaced apart relationship. As noted below, in some embodiments, the loop 22 is configured to provide a degree of flex to allow arms 24*a*, 24*b* to be flexed during insertion with a puller portion 40 and, in some embodiments, removal from the puller portion 40. In FIG. 1A, arm 24*a* may be flexed outward as indicated by arrow a and arm 24*b* may be flexed outward as indicated by arrow b such that the loop portion 40 may be inserted for connection as indicated by arrow c thereby allowing extensions 26*a*, 26*b* and tabs 28*a*, 28*b* to be inserted in respective arm channels 46*a*, 46*b* and thereby lock within extension slots 50*a* (see FIG. 2C) and/or tab slots 44*a*, 44*b*, as depicted in the underside and upper side views provided in FIG. 1B and FIG. 1C, respectively. The loop 22 may define various inner and outer permitters, such as arcuate, oblong, one or more vertexes and straight length sides or edges, e.g., half square, or other suitably shaped perimeters. Other variations are also contemplated. For example, in some embodiments, the loop portion 20 is not rigid and/or only a single arm 24*a*, 24*b* extends from the loop 22.

One or more extension 26*a*, 26*b* may extend from an arm 24*a*, 24*b*. The extension 26*a*, 26*b* will typically extend medially or inwardly relative to a longitudinal axis, depicted as line A in FIG. 2B, of the loop portion 20; however, lateral or outward extensions in addition to or instead of inward extensions are also contemplated. The thickness and/or width of the extensions 26*a*, 26*b* may correspond to or be greater or lesser than that of the arms 24*a*, 24*b* from which they extend. An extension 26*a*, 26*b* may extend at a consistent or tapered thickness from an arm 24*a*, 24*b*. For example, the thickness of an extension 26*a*, 26*b* may decrease from the arm 24*a*, 24*b* toward a tab 28*a*, 28*b*. Additionally or alternatively, a width of the extension 26*a*, 26*b* may extend at a consistent or at a tapered width from the arm 24*a*, 24*b*.

As introduced above, one or more tabs 28*a*, 28*b* may position along an extension 26*a*, 26*b*. For example, a tabs 28*a*, 28*b* may extend from an extension 26*a*, 26*b* at a consistent or tapered width and/or thickness. A thickness of a tab 28*a*, 28*b* along one or more portions of its length will typically be greater than that of an extension 26*a*, 26*b* or may be configured to position at a greater height relative to the arm 24*a*, 24*b* and/or extension 26*a*, 26*b*. Tabs 28*a*, 28*b* may be provided in same or different shapes. Shapes may include circles, ovals, triangles, quadrilaterals, pentagons, hexagons, or other geometric or non-geometric shapes. One or more side surfaces of tabs 28*a*, 28*b* may be configured to engage corresponding side surfaces of tab slots 44*a*, 44*b*, described in more detail below. Upper surfaces of tabs 28*a*, 28*b* may be planar or include one or more elevated and/or recessed surface contours. When received within a tab slot 44*a*, 44*b*, an upper surface of the tab 28*a*, 28*b* may be recessed, level, or raised with respect to the adjacent surface 45*a*, 45*b* of the puller body 42 around the tab slot 44*a*, 44*b*. A an upper portion of the tab 28*a*, 28*b* may be raised within the tab slot 44*a*, 44*b* to provide an interference fit.

As introduced above, a puller portion 40 may include a puller body 42. The puller body 42 may be configured to be gripped by a user. One or more tab slots 44*a*, 44*b* may be defined in the puller body 42. In various embodiments, the puller body 44*a*, 44*b* may include tab slots 44*a*, 44*b* on an upper side 45*a* and/or lower side 45*b*. In one embodiment, tab slots 44*a*, 44*b* may be provided on lateral sides and/or internally such that the interaction with tabs is not visible from the exterior.

In various embodiments, the puller body 42 may include one or more arm channels 46*a*, 46*b* through which arms 24*a*, 24*b* may extend to position tabs 28*a*, 28*b* in tab slots 44*a*, 44*b*. Arm channels 46*a*, 46*b* may be defined by one or more walls 48*a*, 48*b*, 48*c*, as most clearly shown in FIG. 2C.

The puller body 42 may define one or more extension slots 50*a* for receiving extensions 26*a*, 26*b*. For example, one or more extension slots 50*a* may be positioned along an arm channel 46*a*, 46*b* for receiving extensions 26*a*, 26*b* when translated through the channel 46*a*, 46*b*. Only a single extension slot 50*a* is visible in the drawings; however, an extension slot is also provided along arm channel 46*b* corresponding to location between the tab slot 44*b* and adjacent arm channel 46*b*. Extension slots 50*a* may receive one or more extensions 26*a*, 26*b*. As noted above, arms 24*a*, 24*b* may be configured to flex outwardly relative to a longitudinal axis of the loop portion 20 to allow tabs 28*a*, 28*b* and/or extension 26*a*, 26*b* to slot through arm channels 46*a*, 46*b* in the puller portion 40 (see, e.g., arrows a and b in FIG. 1A) but have sufficient elasticity or resilience to return to an inward position when slotted to insert tabs 28*a*, 28*b* in tab slots 44*a*, 44*b*. When multiple extensions 26*a*, 26*b* are provided on an arm 24*a*, 24*b* that extend outward of the arm 24*a*, 24*b* in a same direction, the extensions 26*a*, 26*b* may slot into a same or different extension slot 50*a*. For example, a distal extension 26*a*, 26*b* may have a greater longitudinal length than a proximal extension slot 50*a* that allows the distal extension 26*a*, 26*b* to slide past the proximal extension slot 50*a* before slotting in the distal extension slot 50. Additionally or alternatively, tabs 28*a*, 28*b* along a first arm 24*a*, 24*b* may be sized differently such that a first tab 28*a*, 28*b*, e.g., larger tab, may be translated beyond a first extension slot 50*a* to allow a second tab 28*a*, 28*b*, e.g., smaller tab, to slot within the first extension slot 50*a* as the arm 24*a*, 24*b* is translated further along the arm channel 46*a*, 46*b*. The first tab 28*a*, 28*b* may simultaneously slot into a second, more distally positioned, extension slot 50*a*. The first and second tabs 28*a*, 28*b* may also slot into first and second tab slots 44*a*, 44*b*. In some embodiments, proximal surfaces 27*a*, 27*b* of extensions 26*a*, 26*b* and/or tabs 28*a*, 28*b* may be configured to engage an internal surface, e.g., a wall 48*d* or vertically positioned structure, defining a channel 46*a*, 46*b* or extension slot 50*a* within the puller body 42 to prevent the loop portion 20 from being pulled from the puller portion 40. Arm channels 46*a*, 46*b* may be positioned along lateral sides and/or along an interior portion of the puller body 42. For example, multiple arms 24*a*, 24*b* of a loop portion 20 may be configured to flex medially inward to extend through an interior arm channel 46*a*, 46*b* and then return to an outward position to insert tabs 28*a*, 28*b* in tab slots 44*a*, 44*b*. In a further example, the arms 24*a*, 24*b* return to the outward position when outwardly directed extensions 26*a*, 26*b* slot into laterally positioned extension slots 50*a*.

The tab slots 44*a*, 44*b* may have a complementary shape to that of the corresponding tab 28*a*, 28*b* and be sized to receive and therein secure the tab 28*a*, 28*b* as the tab 28*a*, 28*b* inserts in the tab slot 44*a*, 44*b*. In some embodiments, tab slots 44*a*, 44*b* are not complementary in shape to the corresponding tab 28*a*, 28*b* but are sized such that the tab 28*a*, 28*b* fits within the tab slot 44*a*, 44*b*. In one example, a proximal surface, relative to the loop portion 20, of a tab 28*a*, 28*b* is configured to engage a corresponding surface of the tab slot 44*a*, 44*b* to prevent proximal movement of the loop portion 20 relative to the puller portion 40 when the tab 28*a*, 28*b* is received within the tab slot 44*a*, 44*b*.

Tab slots 44*a*, 44*b* may be aligned or offset relative to a longitudinal axis of the puller portion 40 corresponding to a longitudinal centerline. In some embodiments, three or more tab slots 44*a*, 44*b* may be provided. For example, an arm 24*a*, 24*b* may include multiple tabs 28*a*, 28*b* on a single extension 26*a*, 26*b* or include multiple extensions 26*a*, 26*b* with one or more tabs 28*a*, 28*b*. Similarly, tabs 28*a*, 28*b* may be aligned or offset relative to a longitudinal axis of the loop portion 20. In some embodiments, tab slots 44*a*, 44*b* may longitudinally overlap such that the longitudinal axis A or a line parallel thereto extends through multiple tab slots 44*a*, 44*b*. As introduced above, in some embodiments, tab slots 44*a*, 44*b* may be provided on multiple sides of the puller body 42.

In the loop portions 20 illustrated in the drawings, two spaced apart arms 24*a*, 24*b* extend from the loop 22. With particular reference to FIGS. 2C-3B, an extension 26*a*, 26*b* extends from each arm 24*a*, 24*b* medially or inward relative to the longitudinal axis A (FIG. 2B) of the loop portion 20 and puller body 42 when aligned (e.g., FIGS. 1A & 2A) or inserted (e.g., FIGS. 1B, 1C, & 2B).

The tabs 28*a*, 28*b* have a trapezoidal shape with leading acute interior angles and trailing interior obtuse angles. The thickness of the tabs 28*a*, 28*b* and extensions 26*a*, 26*b* will typically be less than the vertical height of the extension slots 50*a*. In the illustrated embodiment, the thickness of the extensions 26*a*, 26*b* taper from the arms 24*a*, 24*b*. In the illustrated embodiment, the thickness tapers along both the upper and lower sides of the extensions 26*a*, 26*b*. In other embodiments, the taper may be along only the upper or lower side. In still another embodiment, the thickness of an extension 26*a*, 26*b* is maintained between the arm 24*a*, 24*b* and the tab 28*a*, 28*b*. Distal leading edges 29*a*, 29*b* of the tabs 28*a*, 28*b* include a chamfer that proximally taper. These distal leading edges 29*a*, 29*b* may be configured to engage the outer edge 49*a*, 49*b* of vertical wall 48*c* within and/or defining arm channels 46*a*, 46*b* to assist in outwardly flexing the arms 24*a*, 24*b*. Once flexed, inner lateral faces 33*a*, 33*b* and/or proximal inner edge 35*a*, 35*b* may engage and translate along wall 48*c* within respective channels 46*a*, 46*b* to guide the extensions 26*a*, 26*b* 28*a*, 28*b* along the channel 46*a*, 46*b*.

Two tab slots 44*a*, 44*b* are defined through an upper surface 45*a* of the puller body 42. The tabs 28*a*, 28*b* and tab slots 44*a*, 44*b* longitudinally overlap and in this embodiment are slightly offset from the longitudinal axis A and overlap along the centerline. The tabs 28*a*, 28*b* and tab slots 44*a*, 44*b* have complementary shaped. In other embodiments, tabs 28*a*, 28*b* and tab slots 44*a*, 44*b* are not completely complementary but at least a portion of the tabs 28*a*, 28*b* are dimensioned to insert within the tab slots 44*a*, 44*b* to provide an interference fit. Arm channels 46*a*, 46*b* extend through the puller body 42 along lateral sides thereof and are defined by walls 48*a*, 48*b*, 48*c*. The arm channels 46*a*, 46*b* provide slotting for extensions 26*a*, 26*b* and tabs 28*a*, 28*b* for insertion and receive the arms 24*a*, 24*b* in an assembled or locked configuration. The arm channels 46*a*, 46*b* extend along the lateral sides 47*a*, 47*b* of the puller portion 40 and are open along the lateral sides 47*a*, 47*b*. An extension slot 50*a* is defined in the puller body 42 along each channel 46*a*, 46*b*. The location of the extension slot 50*a* and tab slot 44*a*, 44*b* correspond to that of the extension 26*a*, 26*b* and tab 28*a*, 28*b* of the corresponding arm 24*a*, 24*b* when the loop portion 20 is received by the puller body 42.

As noted above, the arms 24*a*, 24*b* are configured to flex outwardly relative to a longitudinal axis of the loop portion 20 to allow tabs 28*a*, 28*b* and/or extension 26*a*, 26*b* to slot through a channel 46*a*, 46*b* in the puller portion 40 but have sufficient elasticity to return to an inward position when slotted to insert tabs 28*a*, 28*b* in tab slots 44*a*, 44*b*. Proximal surfaces 27*a*, 27*b* along tabs 28*a*, 28*b* or extensions 26*a*, 26*b* may be configured to engage proximal walls 48*d* within extension slots 50*a*. The upper face 30*a*, 30*b* of the tabs 28*a*, 28*b* may be position at an outwardly increasing angle such that the upper face 30*a*, 30*b* contacts an underside of an outer lateral edge of a tab slot 44*a*, 44*b* and inward movement of the tabs 28*a*, 28*b*, which may be biased by the outward flexure of the arms 24*a*, 24*b*, drives the tabs 28*a*, 28*b* downward as indicated by arrow d in FIG. 3A, elastically deforming the extension 26*a*, 26*b* downward, until the upper surface 30*a*, 30*b* has extended beyond the outer lateral edge of the tab slot 44*a*, 44*b*. As the upper surface 30*a*, 30*b* is freed from the restriction of the outer lateral edge defining the tab slot 44*a*, 44*b*, the compressive force is removed and the resilience of the extension 26*a*, 26*b* drives the return of the extension 26*a*, 26*b* upward as indicated by arrow e in FIG. 3A to position the tab 28*a*, 28*b* within the tab slot 44*a*, 44*b*. Once in the tab slot 44*a*, 44*b*, an interference fit is provided within the dimensions of the tab slot 44*a*, 44*b* and the strength of the extension 26*a*, 26*b* maintaining the position of the tab 28*a*, 28*b*. As shown, the puller body 42 is configured to be gripped by a user and include an accessory TSA lock slot.

In some embodiments, the puller portion 40 and loop portion 20 may be disconnected by pushing the tabs 28*a*, 28*b* downward in the tab slots 44*a*, 44*b* with sufficient load to flex the extensions a sufficient distance such that the outer lateral edge 37*a*, 37*b* of the tabs 28*a*, 28*b* positions below the outer lateral edge defining the tab slot 44*a*, 44*b*. While the arms 24*a*, 24*b* are flexed outwardly, the loop portion 20 may be pulled away from the puller portion 40 to slide the extensions 26*a*, 26*b* along the channels 46*a*, 46*b* to free the loop portion 20 from the puller portion 40.

In some embodiments, the puller body 42 may be formed of a metal, metallic, alloy, plastic or the like. In one example, the puller body 42 comprises zinc. The loop portion 20 may be formed of a same or different material as the puller body 42. In some embodiments, the loop portion 20 is formed of a material having flexibility characteristics described herein. In one example, the loop portion 20 comprises a plastic. In some embodiments, the loop portion 20 is configured to break before a slider 92 puller connector 90.

Although specific arrangements have been illustrated and described herein, it should be appreciated that any arrangement calculated to achieve the same purpose may be substituted for the specific arrangement shown. This disclosure is intended to cover any and all adaptations or variations of various embodiments and arrangements of the invention. Combinations of the above arrangements, and other arrangements not specifically described herein, will be apparent to those of skill in the art upon reviewing the above description. Therefore, it is intended that the disclosure not be limited to the particular arrangement(s) disclosed as the best mode contemplated for carrying out this invention, but that the invention will include all embodiments and arrangements falling within the scope of the appended claims.

The foregoing is provided for purposes of illustrating, explaining, and describing embodiments of this invention. Modifications and adaptations to these embodiments will be apparent to those skilled in the art and may be made without departing from the scope or spirit of this invention. Upon reviewing the aforementioned embodiments, it would be evident to an artisan with ordinary skill in the art that said embodiments can be modified, reduced, or enhanced without departing from the scope and spirit of the claims described below.

What is claimed is:

1. A zipper puller configured to connect to a zipper slider, the zipper puller comprising:

a puller portion comprising:

a first arm channel extending along a first lateral side and a second arm channel extending along a second lateral side;

a first extension slot located along the first arm channel and a second extension slot located along the second arm channel; and a first tab slot located within the first extension slot and defined through a surface of the puller portion and a second tab slot located within the second extension slot and defined through the surface of the puller portion; and a loop portion comprising:

a loop;

a first arm and a second arm, each arm extending approximately parallel from the loop; and a first extension including a first tab and extending toward the second arm and a second extension including a second tab and extending toward the first arm, wherein the puller portion and the loop portion are configured to couple to connect the zipper puller to a zipper slider, wherein the first and second arms are configured to flex away from each other to position the first and second tabs within corresponding first and second arm channels such that the respective arms may translate along the respective arm channels toward the respective extension slots, wherein the first and second arms are resilient when flexed to urge the first and second extensions into the respective extension slots along the arm channels to position the first and second tabs within the first and second tab slots to thereby coupling the puller portion and loop portion.

2. The zipper puller of claim 1, wherein the first and second tab slots have a trapezoidal shape.

3. The zipper puller of claim 1, wherein the first and second tabs have a trapezoidal shape with a leading acute interior angle.

4. The zipper puller of claim 1, wherein the first and second arm channels are open along the lateral side of the puller portion.

5. The zipper puller of claim 1, wherein the zipper puller extends along a longitudinal axis, and wherein the first and second tab slot longitudinally overlap relative to the longitudinal axis.

6. The zipper puller of claim 5, wherein the first and second tab slots extend across a longitudinal centerline of the zipper puller.

7. The zipper puller of claim 1, wherein the first and second tabs include an upper surface, and wherein the upper surface positions above the respective arm from which the tab extends.

8. The zipper puller of claim 1, wherein the first and second tabs and first and second tab slots are dimensioned to provide an interference fit when the respective tabs are positioned within the respective tabs slots.

9. A zipper puller configured to connect to a zipper slider, the zipper puller comprising:

a puller portion comprising:

arm channels;

an extension slot located along each arm channel; and a tab slot located within each extension slot; and a loop portion comprising:

a loop;

arms extending from the loop; and an extension extending from each arm, each extension including a tab, wherein the puller portion and the loop portion are configured to couple to connect the zipper puller to a zipper slider when the arms position the tabs within the tab slots to provide an interference fit.

10. The zipper puller of claim 9, wherein the arms are configured to flex outwardly to position tabs within arm channels such that the arms may translate along the arm channels toward the extension slots, wherein the arms are resilient when flexed to urge the extensions into the extension slots along the arm channels to position the tabs within the tab slots, thereby coupling the puller portion and loop portion.

11. The zipper puller of claim 9, wherein at least one tab slot is defined in an upper surface of the puller portion.

12. The zipper puller of claim 9, wherein at least one tab slot has a trapezoidal shape.

13. The zipper puller of claim 9, wherein at least one tab has a leading distal edge that tapers toward the loop.

14. The zipper puller of claim 9, wherein at least one arm channel extends along a lateral side of the puller portion and the lateral side is open.

15. The zipper puller of claim 9, wherein the arm channels comprise a first arm channel that extends along a first lateral side of the puller portion and a second arm channel that extends along a second lateral side of the puller portion that is different from the first lateral side.

16. The zipper puller of claim 9, wherein the arms extend from the loop approximately parallel to each other.

17. The zipper puller of claim 16, wherein a first extension along a first arm extends from the first arm toward a second arm, and wherein a second extension along the second arm extends from the second arm toward the first arm.

18. The zipper puller of claim 9, wherein the zipper puller extends along a longitudinal axis, wherein a first and a second tab slot longitudinally overlap relative to the longitudinal axis.

19. The zipper puller of claim 18, wherein the first and second tab slots extend across a longitudinal centerline of the zipper puller.

20. The zipper puller of claim 9, wherein the tabs include an upper surface, and wherein the upper surface positions above the arm from which the tab extends.

* * * * *